US006684037B2

(12) United States Patent
Tamaoki

(10) Patent No.: US 6,684,037 B2
(45) Date of Patent: Jan. 27, 2004

(54) FIXING APPARATUS AND IMAGE FORMING APPARATUS PROVIDED WITH FIXING APPARATUS

(75) Inventor: Tomohiro Tamaoki, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 10/159,128

(22) Filed: Jun. 3, 2002

(65) Prior Publication Data

US 2002/0186982 A1 Dec. 12, 2002

(30) Foreign Application Priority Data

Jun. 7, 2001 (JP) ..... 2001-171981
Jun. 11, 2001 (JP) ..... 2001-175177
Feb. 26, 2002 (JP) ..... 2002-049574

(51) Int. Cl.[7] ..... G03G 15/20
(52) U.S. Cl. ..... 399/69; 219/216; 399/333
(58) Field of Search ..... 399/67, 69, 320, 399/328, 330, 333, 324; 219/216; 347/156

(56) References Cited

U.S. PATENT DOCUMENTS 4,512,649 A * 4/1985 Derimiggio ..... 219/216
4,821,069 A * 4/1989 Kusumoto ..... 219/216
5,819,136 A * 10/1998 Tomita et al. ..... 399/69
5,999,768 A * 12/1999 Gillen et al. ..... 399/69 X
6,405,013 B2 * 6/2002 Haneda et al. ..... 399/330

FOREIGN PATENT DOCUMENTS

JP 05-126647 * 5/1993
JP 11-153923 * 6/1999
JP 2001-034109 * 2/2001

* cited by examiner

*Primary Examiner*—Sandra Brase
(74) *Attorney, Agent, or Firm*—Fitzpatrick, Cella, Harper & Scinto

(57) ABSTRACT

The fixing apparatus has a fixing member which is heated by a heating member and for heating and fixing a toner image on a recording material, temperature detecting device for detecting a temperature of the fixing member by absorbing an infrared ray emitted from the fixing member, and controlling device for controlling power-supply to the heating member, based on an output of the temperature detecting device. In the fixing apparatus, an infrared ray emissivity of the fixing member is equal to or lower than an infrared ray emissivity of the toner within a detection range of the temperature detecting device.

41 Claims, 3 Drawing Sheets

FIXING APPARATUS AND IMAGE FORMING APPARATUS PROVIDED WITH FIXING APPARATUS

BACKGROUND OF THE INVENTION

1. Field of the Invention

The present invention relates to a fixing apparatus that is used in an electrophotographic apparatus, an electrostatic recording apparatus and the like and, more specifically, to a fixing apparatus in which a temperature detecting element is arranged on a heating element in a non-contact state.

2. Description of Related Art

Many fixing apparatuses such as a fixing apparatus of a roller system using a heating roller that is heated by a halogen heater and a fixing apparatus of a belt system for heating a heat-resistant belt by a ceramic heater or a halogen heater are used in image forming apparatuses such as a copying machine and a laser printer.

In such fixing apparatuses, temperature detecting means such as a thermistor for maintaining a surface temperature of a heating roller at a predetermined temperature and a temperature fuse or a thermoswitch for breaking a power supply path to a heater when a temperature of a heating roller rises to an abnormal level is often caused to abut a surface of a fixing roller or a fixing belt that contacts a recording material.

As a result, a contact damage occurs on the surface of the fixing roller or the fixing belt, which may cause a problem such as a white streak, a black streak and defective fixing.

Thus, it is possible to employ a method of causing the temperature detecting means to abut the surface of the fixing roller or the fixing belt outside an image area where the recording material passes. However, since detection of a temperature in the image area is impossible and the fixing apparatus becomes larger in size, a method of bringing the temperature detecting means close to the fixing roller within the image area in a non-contact state has been considered recently.

As the temperature detecting means for detecting a temperature of the fixing roller in a non-contact state, for example, there are temperature detecting means that uses a thermopile or arranges a thermistor on an infrared ray absorbing film functioning as a film member. The non-contact temperature detecting means is provided with a casing having an opening portion, an infrared ray absorbing film that is contained in this casing and consists of a polymeric material for absorbing an infrared ray that has passed through the opening portion, a thermistor element for film temperature detection that is disposed in close adherence to this infrared ray absorbing film, and a thermistor element for temperature compensation for detecting an ambient temperature in the vicinity of this thermistor element for film temperature detection.

Here, the non-contact temperature detecting means will be described.

In this non-contact temperature detecting means, an infrared ray that has passed the opening portion of the casing is absorbed by the infrared ray absorbing film disposed immediately below the opening portion, whereby the temperature of the infrared ray absorbing film rises. Then, the thermistor element for film temperature detection, which is disposed in close adherence to the infrared ray absorbing film, detects the change in temperature. The thermistor element for temperature compensation for measuring an atmospheric temperature in the casing is disposed in the vicinity of the thermistor element for film temperature detection. A difference between temperatures detected by the thermistor element for film temperature detection and the thermistor element for temperature compensation, respectively, is detected as a potential difference by a bridge circuit, whereby an absolute amount of the infrared ray that has passed the opening portion is detected and a temperature of the measured member is measured in a non-contact state. In this way, in the non-contact temperature detecting means, a temperature of the fixing roller or the fixing belt can be detected by measuring the temperature of the film that has absorbed the infrared ray.

With such non-contact temperature detecting means, a temperature of a fixing roller is estimated and detected by receiving or absorbing an infrared ray emitted from the fixing roller, which is an object of temperature detection. Thus, a temperature detecting ability of the temperature detecting means can be improved by increasing an infrared ray emissivity of the fixing roller. Therefore, a method of increasing the infrared ray emissivity by mixing carbon black in a material forming a surface layer of the fixing roller has been considered.

However, with the above-described conventional temperature detecting means, since a change in the temperature of the fixing roller is estimated and detected by receiving or absorbing an infrared ray emitted from the fixing roller, which is an object of temperature detection, if the fixing roller is contaminated by toner while being used or toner is offset on the fixing roller, a detected temperature deviates.

As a result, if the temperature detecting means detects a temperature on the surface of the fixing roller as a temperature higher than an actual temperature, a controlled temperature of the fixing roller drops lower than a predetermined value. However, a harmful effect in this case is defective fixing or jam due to defective separation, which means that a recording material cannot be separated from the fixing roller. An image forming apparatus suffered from such a harmful effect can be restored by cleaning the surface of the fixing roller or replacing the fixing roller. On the other hand, if the temperature detecting means detects a temperature on the surface of the fixing roller as a temperature lower than an actual temperature, a controlled temperature of the fixing roller exceeds the predetermined value. Then, since a temperature inside an image forming apparatus rises abnormally by heat from the fixing apparatus, a lot of harmful effects occur. For example, toner in a developing device of the image forming apparatus becomes solid, a security problem arises due to the abnormal temperature rising, an excessive temperature rising detecting member provided in addition to the temperature detecting means detects excessive temperature rising of the fixing roller, and a rubber material and the like used in the fixing roller of the fixing apparatus deteriorates earlier. It requires a lot of time and costs to restore the image forming apparatus.

Thus, it is an object of the present invention to provide a fixing apparatus that can detect a temperature of a fixing member without detecting it as a temperature lower than an actual temperature, even if the fixing member is contaminated by a developer and can prevent a lot of harmful effects as described above and an image forming apparatus provided with this fixing apparatus.

On the other hand, with the non-contact temperature detecting means, since a temperature of the fixing roller or the fixing belt is detected by measuring a temperature of the film that has absorbed an infrared ray, a difference of resistance values of the thermistor element for temperature compensation and the thermistor element for infrared ray detection can be increased at the time when a certain amount of infrared ray is absorbed in the infrared ray absorbing film by increasing an infrared ray absorptivity of the infrared ray absorbing film, and the temperature detecting ability of the temperature detecting means can be improved. Therefore, a method of mixing carbon black in the infrared ray absorbing film or coating the surface of the infrared ray absorbing film with a blackbody paint has been considered.

However, with the above-described non-contact temperature detecting means, a change in a temperature of the infrared ray absorbing film that has absorbed an infrared ray emitted from a fixing roller or a fixing belt, which is an object of temperature detection, is detected. Therefore, if the infrared ray absorbing film is contaminated by toner scattered in the fixing apparatus, wax contained in the toner or silicon oil or the like applied to the fixing roller or the like as a release agent, a detected temperature deviates. As a result, if the temperature detecting means detect a temperature on the surface of the fixing roller as a temperature lower than an actual temperature, abnormal temperature rising of the fixing roller occurs, which causes a security problem or results in earlier deterioration of the fixing roller and the like of the fixing apparatus.

Therefore, in order to prevent deterioration and the like due to abnormal temperature rising of the fixing roller, there is required a method which does not detect a temperature on the surface of the fixing roller as a temperature lower than an actual temperature, even if the infrared ray absorbing film is contaminated by toner or the like.

SUMMARY OF THE INVENTION

The present invention has been devised in view of the above-mentioned drawbacks, and it is an object of the present invention to provide a heating apparatus that can detect a temperature of a fixing member without detecting it as a temperature lower than an actual temperature, even if the fixing member is contaminated by a developer, or even if a film of infrared ray detecting means is contaminated by a developer or the like, thereby preventing deterioration and the like of a fixing apparatus and an image forming apparatus due to abnormal temperature rising of the fixing member.

It is another object of the present invention to provide a fixing apparatus including: a fixing member which is heated by a heating member, for heating and fixing a toner image on a recording material; temperature detecting means for detecting a temperature of the fixing member by absorbing an infrared ray emitted from the fixing member; and controlling means for controlling power-supply to the heating member, based on an output of the temperature detecting means, in which an infrared ray emissivity of the fixing member is lower than an infrared ray emissivity of the toner within a detection range of the temperature detecting means.

It is still another object of the present invention to provide a fixing apparatus including: a fixing member which is heated by a heating member, for heating and fixing a toner image on a recording material; a film for absorbing an infrared ray emitted from the fixing member; temperature detecting means for detecting a temperature of the film; and controlling means for controlling power-supply to the heating member, based on an output of the temperature detecting means, in which an infrared ray absorptivity of the film is equal to or lower than an infrared ray absorptivity of the toner within a wavelength region emitted from the fixing member.

It is still another object of the present invention to provide a fixing apparatus including: a fixing member which is heated by a heating member, for heating and fixing a toner image on a recording material; an oil for being applied onto the fixing member; a film for absorbing an infrared ray emitted from the fixing member; temperature detecting means for detecting a temperature of the film; and controlling means for controlling power-supply to the heating member, based on an output of the temperature detecting means, in which an infrared ray absorptivity of the film is equal to or lower than an infrared ray absorptivity of the oil within a wavelength region emitted from the fixing member.

It is still another object of the present invention to provide a fixing apparatus including: toner which contains wax; a fixing member which is heated by a heating member, for heating and fixing a toner image on a recording material; a film for absorbing an infrared ray emitted from the fixing member; temperature detecting means for detecting a temperature of the film; and controlling means for controlling power-supply to the heating member, based on an output of the temperature detecting means, in which an infrared ray absorptivity of the film is equal to or lower than an infrared ray absorptivity of the wax within a wavelength region emitted from the fixing member.

Still other objects of the present invention will be apparent in the following description.

DETAILED DESCRIPTION OF THE PREFERRED EMBODIMENTS

Figure 1:
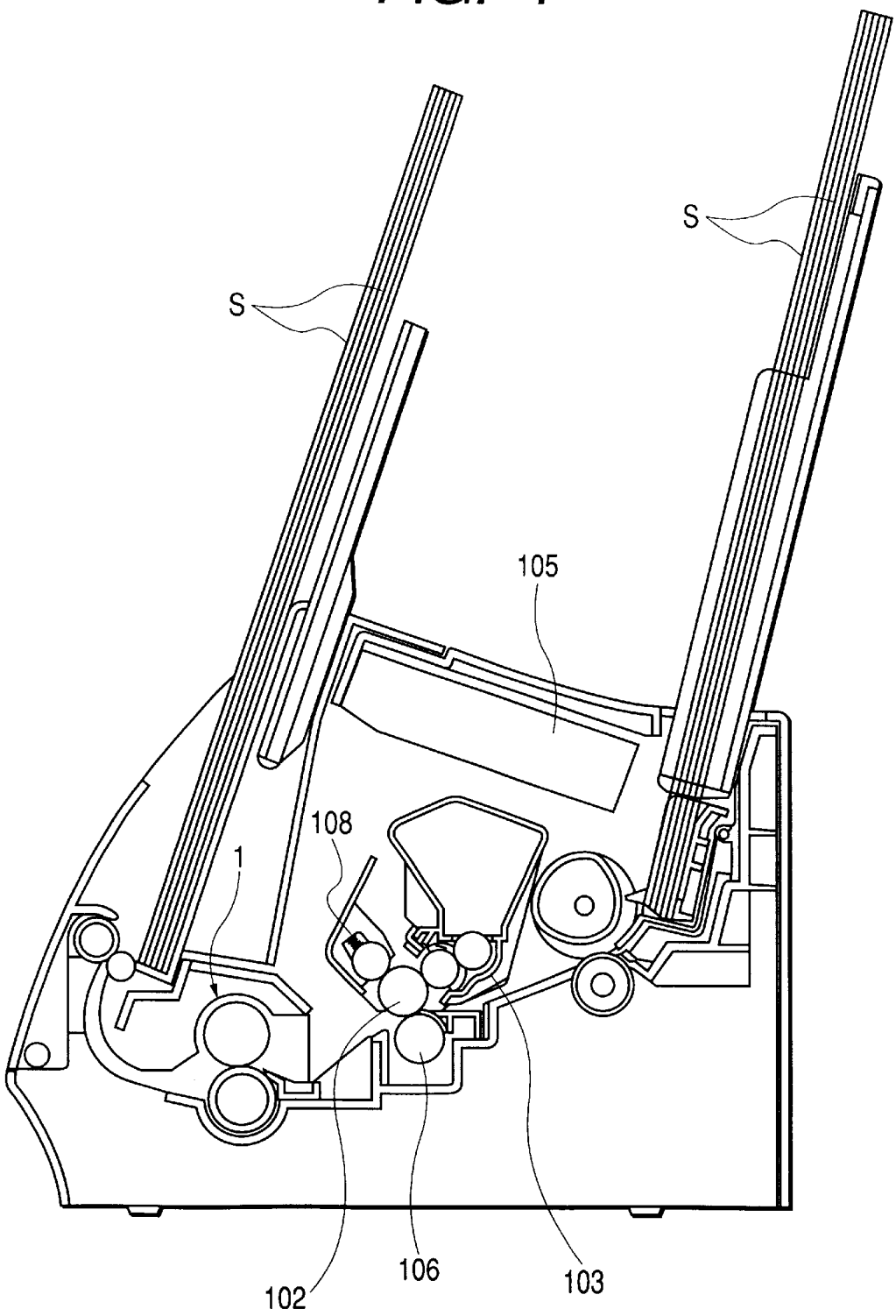
FIG. 1 is a view showing a schematic structure of an example of an image forming apparatus in accordance with an embodiment mode of the present invention.

FIG. 1 is a view showing a schematic structure of an example of an image forming apparatus in accordance with this embodiment mode.

As shown in FIG. 1, such an image forming apparatus is provided with an image bearing member 102 of which surface an electrostatic latent image is formed on, pre-exposure means (not shown) for removing charges on the surface of the image bearing member 102, primary charging means 108 for charging the surface of the image bearing member 102 at a desired potential, exposing means 105 for exposing the surface of the image bearing member 102 charged by the primary charging means 108 to form an electrostatic latent image, a developing device 103 for developing the electrostatic latent image on the image bearing member 102 with toner functioning as a developer, to turn it into a toner image, a transferring apparatus 106 for transferring the toner image on the image bearing member 102 developed by the developing device 103 to a recording material S, and the like.

In addition, as shown in FIG. 1, in such an image forming apparatus, a fixing unit 1 functioning as a fixing apparatus for fusing and fixing the toner image transferred to the recording material S onto the recording material S is arranged in a predetermined position of the image forming apparatus and each process of image formation is appropriately executed by each of the above-described apparatuses, whereby a desired image can be obtained. Further, recording paper, an OHP sheet and the like are used as a recording material.

Here, a structure of the fixing unit 1 will be described in detail.

Figure 2:
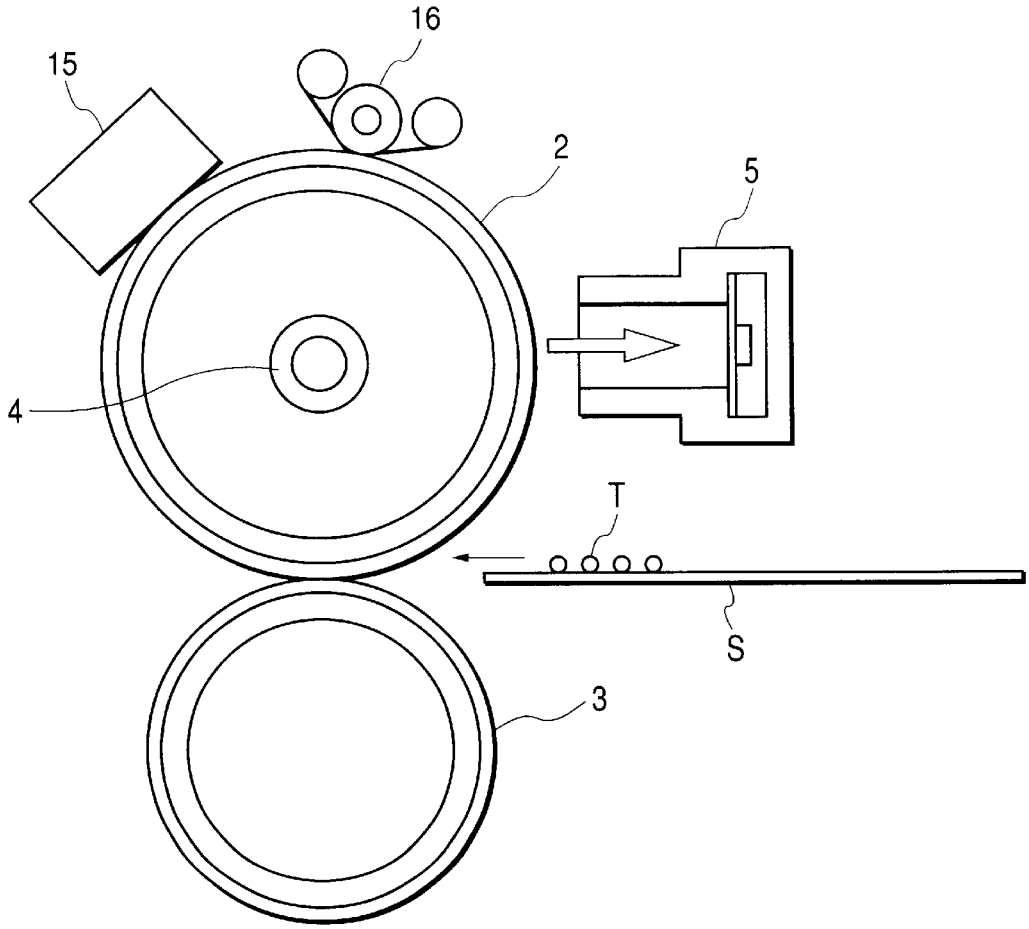
FIG. 2 is a view showing a schematic structure of a fixing apparatus in accordance with the embodiment mode of the present invention.

As shown in FIG. 2, the fixing unit 1 as a heating apparatus is provided with a heater 4 as heating means, a fixing roller 2 as a member to be heated containing the heater 4, a pressure roller 3 as a pressurizing member and a temperature detecting element 5 as temperature detecting means.

The fixing roller 2 is a roller in which a layer of a heat-resistant elastic member such as silicone rubber and fluororubber is formed around a pipe material such as aluminum and iron and a releasing layer such as a PFA and a PTFE is coated over the surface of the layer.

The pressure roller 3 is disposed in press contact with the fixing roller 2. Similarly to the fixing roller 2, the pressure roller 3 is a roller in which a layer of a heat-resistant elastic member such as silicone rubber and fluororubber is formed around a cored bar.

The heater 4 is disposed inside the fixing roller 2 and heats the fixing roller 2 from its inside. The heater 4 is usually used as a heating source of a fixing apparatus, and an example of the heater 4 includes a halogen heater and the like.

As the recording material S is passed between the fixing roller (heating member) 2 and the pressure roller (backup member) 3, toner T on the recording material S is heated and pressurized between the fixing roller 2 and the pressure roller 3 to be fixed on the recording material S.

In addition, a temperature detecting element 5 is arranged facing the fixing roller 2 in a non-contact state in order to detect a surface temperature of the fixing roller 2 and detects a temperature of the fixing roller 2. The surface temperature of the fixing roller 2 is maintained at a predetermined set temperature (print temperature) or a standby temperature at non-fixing time based on data from the temperature detecting element 5. Further, a thermoswitch 15 for breaking a power supply path to the heater 4 at the time of excessive temperature rising of the fixing roller 2 is attached outside an image area at an end portion in an axial direction of the fixing roller 2 in a contact state with respect to the surface of the fixing roller 2.

As shown in FIG. 2, a cleaning web 16 as a cleaning member for cleaning a surface layer of a member to be heated is abutted on the fixing roller 2. The fixing roller 2 is cleaned by the web 16 that is nonwoven fabric containing oil such as silicon oil and, at the same time, a releasing property of the fixing roller 2 and the recording material S is improved. Note that a structure that does not have a cleaning member can also be employed.

Figure 3:
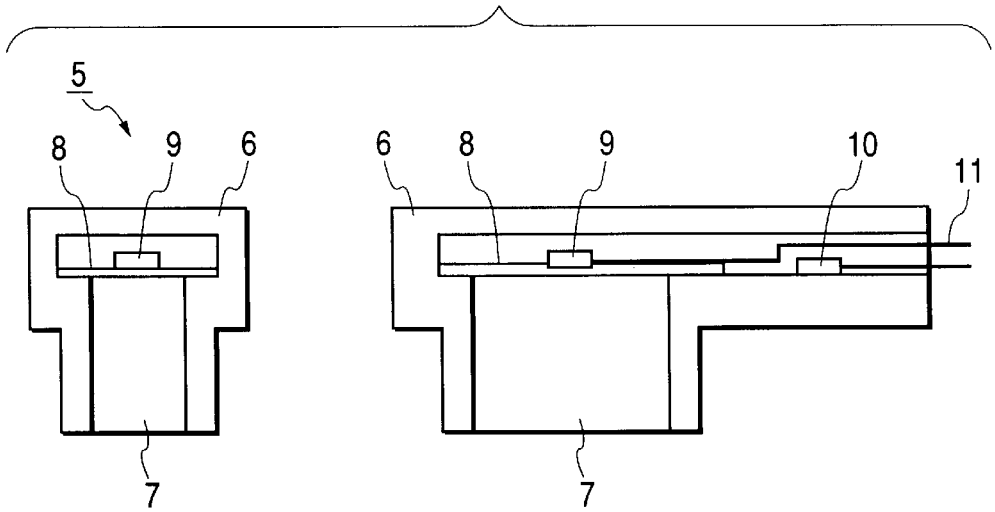
FIG. 3 is a view showing a schematic structure of non-contact temperature detecting means provided in the fixing apparatus.

Next, a structure of the temperature detecting element 5 will be described with reference to FIG. 3.

The temperature detecting element 5 is constituted of a casing 6, an opening portion 7 through which an infrared ray of an object whose temperature is detected is made incident, a film 8 attached to the opening portion 7, a thermistor element for infrared ray detection 9 and a thermistor element for temperature compensation 10 for detecting a temperature of the casing 6.

In the temperature detecting element 5, the heat-resistant film 8 made of a resin functioning as a film member for absorbing an infrared ray emitted from an object is provided in the opening portion 7, which is provided on one side of the casing 6 made of a material with high thermal conductivity such as aluminum, in such a manner as to block the opening portion 7.

The thermistor element for infrared ray detection 9 functioning as film temperature detecting means is fixed in close adherence to the interior side of the casing 6 of the heat-resistant film 8 by an adhesive or the like. The thermistor element for temperature compensation 10 for measuring an atmospheric temperature in the casing 6 is disposed in the vicinity of the thermistor element for infrared ray detection 9.

Lead wires 11 of the thermistor element for infrared ray detection 9 and the thermistor element for temperature compensation 10 are connected to sockets (not shown) provided in the casing 6 and are drawn out to the outside, respectively.

Figure 4:
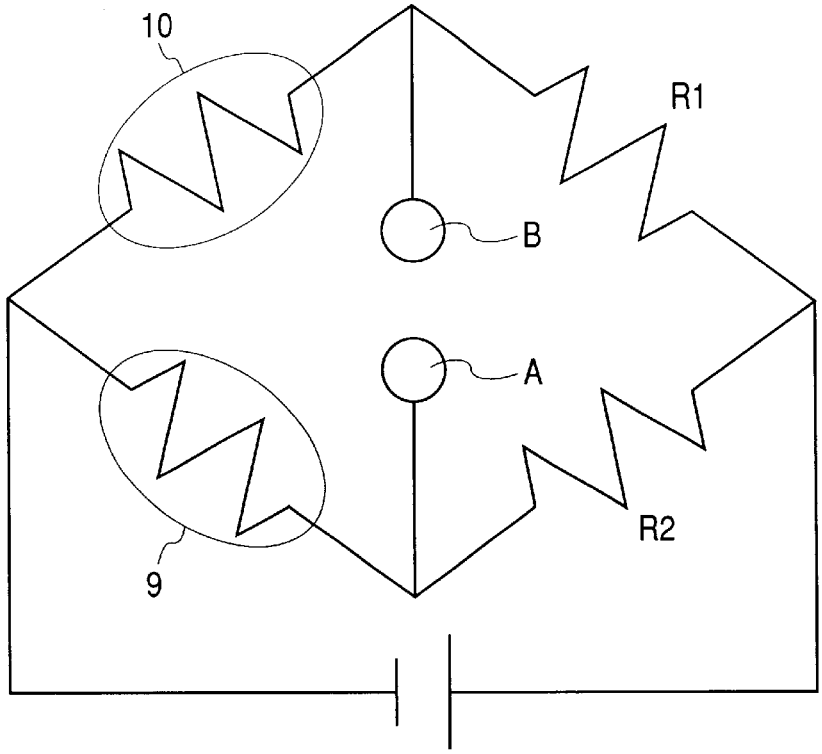
FIG. 4 is a view for explaining a circuit structure of the non-contact temperature detecting means.

As shown in FIG. 4, the thermistor element for temperature compensation 10 and the thermistor element for infrared ray detection 9 constitute a bridge circuit including resistances R1 and R2 to be used. Their outputs are outputted as a potential difference generated between terminals A and B to detect an absolute amount of an infrared ray.

Next, operations of the temperature detecting element 5 will be described briefly. First, when an infrared ray from the fixing roller 2 is made incident on the infrared ray absorbing film 8 of a resin attached to the opening portion 7 of the casing 6, the infrared ray is absorbed in the infrared ray absorbing film 8 and a temperature of the infrared ray absorbing film 8 rises according to an amount of the infrared ray, that is, according to temperature rising of the fixing roller 2. Then, the temperature of the infrared ray absorbing film 8 is conducted to the thermistor element for film temperature detection 9, which is fixed in close adherence to the back of the film, and detected as a change in a resistance of the thermistor element for film temperature detection 9. The resistance of the thermistor element for film temperature detection 9 is subject to influence by an environmental temperature under which the temperature detecting element 5 is placed. Therefore, the influence is removed by detecting a temperature equivalent to the environmental temperature using the thermistor element for temperature compensation 10.

Here, it is for the purpose of improving follow-up ability of the thermistor element for temperature compensation 10 with respect to a change in an environmental temperature that the casing 6 is made of a material with high heat conductivity such as aluminum.

A difference between temperatures detected by the thermistor element for film temperature detection 9 and the thermistor element for temperature compensation 10, respectively, is detected as a potential difference by the above-described bridge circuit, whereby a temperature of the fixing roller 2, which is an object of temperature detection, can be measured in a non-contact state. If the temperature of the fixing roller 2 is recognized as excessively high, it is preferable to provide means capable of inhibiting heating of the heater 4 in the fixing roller 2 in the fixing apparatus.

Next, an infrared ray emissivity will be described. An emissivity of a complete blackbody (a body that emits an infrared ray ideally) is defined as one. An emissivity of a body is an amount of emission of an infrared ray represented by a ratio and is always one or less.

Then, a method of determining an infrared ray emissivity of an object will be described briefly.

In determining an infrared ray emissivity, it can be easily measured in general utilizing an infrared emission thermometer of a thermopile system or the like. In a state in which an object 1 for which an infrared ray emissivity is desired to be determined and an object 2 for which an infrared ray emissivity is already known are kept at the same temperature, a temperature of the object 2 is measured by an infrared emission thermometer of a thermopile system or the like. Next, the infrared emission thermometer of a thermopile system is adjusted such that a temperature of the object 1 is equal to the measured value, whereby it becomes possible to measure an infrared ray emissivity of the object 1.

First, a first embodiment will be described.

For example, an infrared ray emissivity of toner was distributed in the range of approximately 0.96 to 0.97 for four colors of toner in a type A color copying machine and was approximately 0.965 for all four colors in a type B color copying machine, approximately 0.965 for all four colors in a type C color copying machine as well and 0.96 for a type D black-and-white copying machine.

If an infrared ray emissivity does not have a wavelength property, in a copying machine in which toner with an infrared ray emissivity of 0.96 to 0.97, a tube made of PFA with an infrared ray emissivity of 0.96 is selected and used as the surface layer of the fixing roller 2, whereby a detected temperature of the temperature detecting element 5 changes little, even if the fixing roller 2 is contaminated by toner or toner is offset on the fixing roller 2.

In addition, if a heat-resistant tube or a coating material with an infrared ray emissivity smaller than 0.96 is used in the surface layer of the fixing roller 2, the infrared ray emissivity increases when the fixing roller 2 is contaminated by toner or toner is offset on the fixing roller 2, and a temperature higher than an actual temperature is detected. That is, if a temperature of the fixing roller 2 on which toner is deposited is controlled, an actual roller temperature deviates to be lower than a planned temperature. Therefore, the fixing roller 2 and the fixing apparatus are not deteriorated and other units in the image forming apparatus are not damaged by abnormal temperature rising.

Here, a range of temperature detection by the temperature detecting member of the present invention is desirably within a range from an environmental temperature of the image forming apparatus to a fixing temperature under which toner can be fixed. For example, it is from a low temperature environment approximately 5° C. to approximately 280° C.

Further, if plural colors of toner are used simultaneously and each color of toner has a different emissivity, an infrared ray emissivity of the fixing roller preferably falls into a range of ±10% of a smallest infrared ray emissivity.

However, since an infrared ray emissivity has a wavelength property, the method of comparing infrared ray emissivity in this way compares only a wavelength region that an infrared emission thermometer, which is used in measuring an infrared ray emissivity, detects. Thus, this method is not accurate actually.

Figure 5:
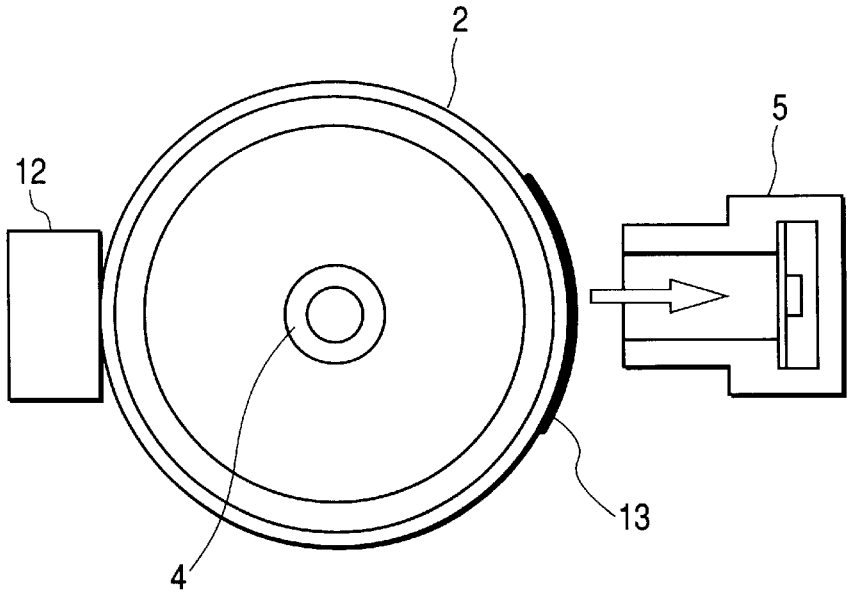
FIG. 5 is a view for explaining an experimental apparatus for measuring a setting of an infrared ray emissivity of a fixing member.

Therefore, for more accurate comparison, it is necessary to compare a magnitude of an infrared ray emissivity using the fixing roller 2 and the temperature detecting element 5 of the actual machine as shown in FIG. 5. That is, a temperature of the fixing roller 2 is controlled by a temperature detecting means 12 such as a thermo-electric couple, which is provided in addition to the temperature detecting element 5, and a temperature of the fixing roller 2 in the state in which toner soil is not deposited thereon is measured by the temperature detecting element 5. Next, each color of toner 13 that is used in the machine is deposited on the surface of the fixing roller 2. It can be determined that an infrared ray emissivity has risen if a detected temperature is higher than a temperature previously measured and that it has fallen if a detected temperature is lower.

If a detected temperature is deviated to a higher side for all colors of toner, carbon black is mixed in a material forming the surface layer of the fixing roller 2, whereby a material with an infrared ray emissivity that is increased within a range not exceeding infrared ray emissivities of all colors of toner can be used. In addition, it is also possible to prevent deterioration of the fixing apparatus due to abnormal temperature rising and damages to other units in the image forming apparatus after increasing a temperature detecting ability.

Another embodiment will be described.

The fixing apparatus of the present invention is characterized in that it fixes an unfixed toner image and an infrared ray absorptivity of an infrared ray absorbing film that absorbs an infrared ray emitted from a fixing roller is equal to or smaller than an infrared ray absorptivity of toner, wax in the toner or silicon oil used as a releasing agent that is likely to deposit on and contaminate the infrared ray absorbing film.

A relationship between infrared ray absorptivities of an infrared ray absorbing film and toner, wax contained in the toner and silicon oil used as a releasing agent will be hereinafter described.

It is generally possible to measure an infrared ray absorptivity easily utilizing an infrared emission thermometer of a thermopile system or the like as described above.

For example, if an infrared ray absorptivity is measured in a wavelength of 6 to 12 $\mu$m, an infrared ray absorptivity of toner is distributed in the range of approximately 0.96 to 0.97 for four colors of toner in a type A color copying machine and is approximately 0.965 for all four colors in a type B color copying machine, approximately 0.965 for all four colors in a type C color copying machine as well and 0.96 for a type D black-and-white copying machine. In addition, infrared ray absorptivities of wax and silicon oil are approximately 0.93 and 0.98, respectively.

However, it is not correct to compare infrared ray absorptivities with such a method in the present invention. This is because, since an infrared ray emissivity and an infrared ray absorptivity have a wavelength property for each material, this method compares only a wavelength region that an infrared emission thermometer, which is used in measuring an infrared ray absorptivity, detects. In the present invention, what matters is an infrared ray absorptivity at the time when an infrared ray absorbing film, toner, wax and oil absorb an infrared ray in a wavelength region emitted by a fixing roller.

Here, a wavelength region emitted from a fixing member of the present invention is a wavelength of an infrared ray. For example, a wavelength is approximately 8 $\mu$m to 14 $\mu$m.

Further, if plural colors of toner are used simultaneously and each kind of toner has a different emissivity, an infrared ray emissivity of the fixing roller preferably falls into a range of ±10% of a smallest infrared ray emissivity.

Therefore, in order to perform accurate measurement, it is necessary to compare a magnitude of an infrared ray absorptivity by the measurement method as shown in FIG. 5.

That is, a temperature of the fixing roller 2 is controlled by a temperature adjusting means 14 such as a thermo-electric couple, which is provided in addition to the temperature detecting element 5, and a temperature of the fixing roller 2 in the state in which toner soil is not deposited thereon is measured by the temperature detecting element 5.

Next, the toner 13 is deposited on the surface of the infrared ray absorbing film 9 of the temperature detecting element 5. It can be determined that an infrared ray absorptivity has risen if a detected temperature is higher than a temperature previously measured and that it has fallen if a detected temperature is lower. Thus, in order to determine if setting of an infrared ray absorptivity of an infrared ray absorbing film attached to the temperature detecting element 5 used in a certain type of a fixing apparatus is adequate, it is important to use toner, wax and silicon oil that are likely to deposit on a fixing roller and an infrared ray absorbing film used in the type of a machine, cause each contaminant to deposit on the infrared ray absorbing film and confirm that a detected temperature remains the same or deviates to a high side in each case. If a detected temperature is deviated to a higher side for all of these contaminants, a material mixed with carbon black is used as the infrared ray absorbing film or the infrared ray absorbing film is coated with blackbody paint, whereby a material that, while having an infrared ray absorptivity that is equal to or lower than the infrared ray absorptivities of the toner, the wax and the silicon oil, has a maximum absorptivity within a range not exceeding these absorptivities can be used. In addition, it is also possible to prevent deterioration of the fixing apparatus due to abnormal temperature rising after increasing a temperature detecting ability.

In addition, if a detected temperature deviates to a lower side with respect to a certain contaminant, it is necessary to lower an infrared ray absorptivity of an infrared ray absorbing film. For this purpose, polyester is used as a base material of the film and an appropriate amount of carbon black is added to it, whereby it becomes possible to set an infrared ray absorptivity equal to that of the contaminant.

A fixing member has been described above with a fixing roller as an example. However, the present invention can be applied to a fixing apparatus that has a film or a belt as a fixing member and heats it by a heater. In addition, it is needless to mention that the present invention is effective not only in a non-contact temperature sensor using an infrared ray absorbing film but also in a temperature sensor of a thermopile system and the like.

As described above, according to the invention of this application, since an infrared ray emissivity of a fixing member in a wavelength region that can be detected by temperature detecting means is lower than an infrared ray emissivity of a developer in the wavelength region, even if the fixing member is contaminated by the developer, a fixing apparatus can detect a temperature of the fixing member without detecting it as a temperature lower than an actual temperature and deterioration and the like of the fixing apparatus and an image forming apparatus due to abnormal temperature rising of the fixing member can be prevented.

Moreover, according to the invention of this application, an infrared ray absorptivity of an infrared ray absorbing film is made equal to or lower than infrared ray absorptivity of toner, wax and silicon oil, whereby, even if toner or the like deposits on the film, since the fixing apparatus detects a temperature of the infrared ray absorbing film as a temperature higher than an actual temperature, the fixing apparatus is not deteriorated by causing excessive temperature rising.

The embodiments of the present invention have been described. It should be noted that the present invention is not limited to the above-described embodiment at all, and various modifications are possible within the technical thought of the present invention.

What is claimed is:

1. A fixing apparatus comprising:

a fixing member which is heated by a heating member, heating and fixing a toner image on a recording material;

temperature detecting means for detecting a temperature of said fixing member by absorbing an infrared ray emitted from said fixing member; and controlling means for controlling power-supply to said heating member, based on an output of said temperature detecting means, wherein an infrared ray emissivity of said fixing member is equal to or lower than an infrared ray emissivity of said toner within a detection range of said temperature detecting means.

2. A fixing apparatus according to claim 1, wherein said toner is heated in contact with said fixing member.

3. A fixing apparatus according to claim 1, said temperature detecting means detects a surface temperature of said fixing member.

4. A fixing apparatus according to claim 1, wherein an infrared ray emissivity of said toner is an infrared ray emissivity of toner on said fixing member.

5. A fixing apparatus according to claim 1, wherein said temperature detecting means is non-contact temperature detecting means.

6. A fixing apparatus according to claim 1, wherein said temperature detecting means has a film made of a heat-resistant resin.

7. A fixing apparatus according to claim 6, wherein a film temperature detecting element is arranged in contact with said infrared ray absorbing film.

8. A fixing apparatus according to claim 7, wherein said film temperature detecting element is a temperature detecting element for infrared ray detection.

9. A fixing apparatus according to claim 1, wherein said film is an infrared ray absorbing film.

10. A fixing apparatus according to claim 1, wherein carbon black is mixed in a surface layer of said fixing member.

11. A fixing apparatus according to claim 10, wherein said surface layer is a releasing layer.

12. A fixing apparatus according to claim 1, further comprising a pressurizing member that forms a nip portion by pressurizing said fixing member to nip and convey a recording material by the nip portion.

13. A fixing apparatus according to claim 1, further comprising:

an image bearing member for bearing a latent image;

a developing device for supplying toner to the latent image; and a transfer device for transferring toner on said image bearing member to a recording material, wherein said fixing apparatus is used in an image forming apparatus.

14. A fixing apparatus comprising:

a fixing member which is heated by a heating member, for heating and fixing a toner image on a recording material;

a film for absorbing an infrared ray emitted from said fixing member;

temperature detecting means for detecting a temperature of said film; and controlling means for controlling power-supply to said heating member, based on an output of said temperature detecting means, wherein an infrared ray absorptivity of said film is equal to or lower than an infrared ray absorptivity of said toner within a wavelength region emitted from said fixing member.

15. A fixing apparatus according to claim 14, wherein said toner is heated in contact with said fixing member.

16. A fixing apparatus according to claim 14, wherein said temperature detecting means detects a surface temperature of said fixing member.

17. A fixing apparatus according to claim 14, wherein said film is arranged in said temperature detecting means.

18. A fixing apparatus according to claim 14, wherein said film is made of a heat-resistant resin.

19. A fixing apparatus according to claim 14, wherein an element for infrared ray detection is in contact with said film.

20. A fixing apparatus according to claim 14, wherein said temperature detecting means is non-contact temperature detecting means.

21. A fixing apparatus according to claim 14, wherein carbon black is mixed in said film.

22. A fixing apparatus according to claim 14, further comprising a pressurizing member that forms a nip portion by pressurizing said fixing member to nip and convey a recording material by the nip portion.

23. A fixing apparatus according to claim 14, further comprising:

an image bearing member for bearing a latent image;

a developing device for supplying toner to the latent image; and a transfer device for transferring toner on said image bearing member to a recording material, wherein said fixing apparatus is used in an image forming apparatus.

24. A fixing apparatus comprising:

a fixing member which is heated by a heating member, for heating and fixing a toner image on a recording material;

an oil for being applied onto said fixing member;

a film for absorbing an infrared ray emitted from said fixing member;

temperature detecting means for detecting a temperature of said film; and controlling means for controlling power-supply to the heating member, based on an output of said temperature detecting means, wherein an infrared ray absorptivity of said film is equal to or lower than an infrared ray absorptivity of said oil within a wavelength region emitted from said fixing member.

25. A fixing apparatus according to claim 24, wherein said oil is silicon oil.

26. A fixing apparatus according to claim 24, said temperature detecting means detects a surface temperature of said fixing member.

27. A fixing apparatus according to claim 24, wherein said film is made of a heat-resistant resin.

28. A fixing apparatus according to claim 24, wherein an element for infrared ray detection is in contact with said film.

29. A fixing apparatus according to claim 24, wherein said temperature detecting means is non-contact temperature detecting means.

30. A fixing apparatus according to claim 24, wherein carbon black is mixed in said film.

31. A fixing apparatus according to claim 24, further comprising a pressurizing member that forms a nip portion by pressurizing said fixing member to nip and convey a recording material by the nip portion.

32. A fixing apparatus according to claim 24, further comprising:

an image bearing member for bearing a latent image;

a developing device for supplying toner to the latent image; and a transfer device for transferring toner on said image bearing member to a recording material, wherein said fixing apparatus is used in an image forming apparatus.

33. A fixing apparatus comprising:

toner which contains wax;

a fixing member which is heated by a heating member, for heating and fixing a toner image on a recording material;

a film for absorbing an infrared ray emitted from said fixing member;

temperature detecting means for detecting a temperature of said film; and controlling means for controlling power-supply to the heating member, based on an output of said temperature detecting means, wherein an infrared ray absorptivity of said film is equal to or lower than an infrared ray absorptivity of said wax within a wavelength region emitted from said fixing member.

34. A fixing apparatus according to claim 33, wherein said toner is heated in contact with said fixing member.

35. A fixing apparatus according to claim 33, said temperature detecting means detects a surface temperature of said fixing member.

36. A fixing apparatus according to claim 33, wherein said film is made of a heat-resistant resin.

37. A fixing apparatus according to claim 33, wherein an element for infrared ray detection is in contact with said film.

38. A fixing apparatus according to claim 33, wherein said infrared ray temperature detecting means is non-contact temperature detecting means.

39. A fixing apparatus according to claim 33, wherein carbon black is mixed in said film.

40. A fixing apparatus according to claim 33, further comprising a pressurizing member that forms a nip portion by pressurizing said fixing member to nip and convey a recording material by the nip portion.

41. A fixing apparatus according to claim 33, further comprising:

an image bearing member for bearing a latent image;

a developing device for supplying toner to the latent image; and a transfer device for transferring toner on said image bearing member to a recording material, wherein said fixing apparatus is used in an image forming apparatus.

* * * * *

UNITED STATES PATENT AND TRADEMARK OFFICE

CERTIFICATE OF CORRECTION

PATENT NO. : 6,684,037 B2
DATED : January 27, 2004
INVENTOR(S) : Tomohiro Tamaoki It is certified that error appears in the above-identified patent and that said Letters Patent is hereby corrected as shown below:

Column 2,
Line 55, “costs” should read -- cost --.
Line 60, “developer” should read -- developer,--.

Column 3,
Line 20, “detect” should read -- detects --.

Signed and Sealed this

First Day of June, 2004

JON W. DUDAS
*Acting Director of the United States Patent and Trademark Office*